US006095515A

United States Patent [19]

Kiyohara et al.

[11] Patent Number: 6,095,515

[45] Date of Patent: Aug. 1, 2000

[54] SHEET SUPPLYING APPARATUS WITH SEPARATING MEANS AND GUIDE

[75] Inventors: Takehiko Kiyohara, Zama; Soichi Hiramatsu, Hachioji; Hiroyuki Inoue, Yokohama; Takashi Nojima, Mitaka; Hitoshi Nakamura, Sanjo; Akira Kida, Yokohama; Hideaki Kawakami, Yokohama; Takeshi Iwasaki, Yokohama; Noriko Kawasaki, Tokyo, all of Japan

[73] Assignee: Canon Kabushiki Kaisha, Tokyo, Japan

[21] Appl. No.: 08/787,546

[22] Filed: Jan. 22, 1997

[30] Foreign Application Priority Data

Jan. 25, 1996 [JP] Japan ..... 8-010939

[51] Int. Cl.[7] ..... B65H 1/04

[52] U.S. Cl. ..... 271/161; 271/162; 271/170; 271/167; 271/121

[58] Field of Search ..... 271/121, 119, 271/167, 161, 162, 118, 127, 170

[56] References Cited

U.S. PATENT DOCUMENTS

| | | | |
|---|---|---|---|
| 5,358,230 | 10/1994 | Ikemori et al. . | |
| 5,370,380 | 12/1994 | Suzuki et al. . | |
| 5,375,826 | 12/1994 | Flores | 271/162 X |
| 5,480,134 | 1/1996 | Weber | 271/162 X |
| 5,480,247 | 1/1996 | Saikawa et al. | 271/119 X |
| 5,485,991 | 1/1996 | Hirano et al. . | |
| 5,527,029 | 6/1996 | Bortolotti et al. . | |
| 5,899,451 | 5/1999 | Kiyohara et al. | 271/161 X |
| 5,918,873 | 7/1999 | Saito et al. | 271/121 X |
| 5,938,355 | 8/1999 | Suzuki | 271/121 X |

FOREIGN PATENT DOCUMENTS

| | | |
|---|---|---|
| 0 672 601 | 9/1995 | European Pat. Off. . |
| WO 89/03798 | 5/1989 | WIPO . |

OTHER PUBLICATIONS

IBM Techical Disclosure Bulletin, vol. 28, No. 12, May 1986, p. 5416.

*Primary Examiner*—Christopher P. Ellis
*Assistant Examiner*—Patrick Mackey
*Attorney, Agent, or Firm*—Fitzpatrick, Cella, Harper & Scinto

[57] ABSTRACT

The present invention provides a sheet supplying apparatus comprising a sheet stacking means for stacking a plurality of sheets, a sheet supply means for feeding out the sheets stacked on the sheet stacking means, a separation means for separating the sheets one by one by abutting the sheets against the separation means to cause elastic angular change in the sheet thereby to ride the sheet over the separation means, and a guide means having a guide surface for guiding the sheet separated by the separation means toward a downstream side, and wherein the sheet stacking means is provided at its downstream end with a projection which protrudes toward downstream sides of the separation means and of the guide surface of the guide means.

13 Claims, 13 Drawing Sheets

S
Sa
Sb
4
4a
4b
4c
5
6
7
8
9
10
11
11c
12
13
16
18
19
20
21
23
24
25
26
27
29
30
31
37
38
39
46
47
47a
47b
48
49
50
50a
50b
51
52
53
53a
53b
54
55
55a
56
57
57a
58
59
59a
59b
60
61
62
63
63a
64
65
M

SHEET SUPPLYING APPARATUS WITH SEPARATING MEANS AND GUIDE

BACKGROUND OF THE INVENTION

1. Field of the Invention

The present invention relates to a sheet supplying apparatus for supplying a sheet (for example, a printing sheet, a transfer sheet, a photosensitive sheet, an electrostatic recording sheet, a print sheet, an OHP sheet, an envelope, a post card, a sheet original or the like) rested on a sheet stacking portion to a sheet treating portion such as a recording portion, a reading portion or a working portion in a recording apparatus (printer) as an information outputting apparatus of a word processor, a personal computer or the like. The sheet supply apparatus is used in an image forming apparatus such as a copying machine, a facsimile or the like, or in other various sheet utilizing apparatuses. Further it relates to a recording apparatus having such a sheet supplying apparatus.

2. Related Background Art

In sheet supplying apparatus for supplying a sheet to a sheet treating portion, it is required to ensure that a sheet is positively separated one by one from sheets stacked as a sheet stack. As a result, in conventional sheet supplying apparatuses, there are limitations due to a condition of the sheet such as a kind of sheet which can be used, thickness and rigidity of the sheet, a bending feature (flexion) of the sheet and/or the like. Thus, in the conventional apparatuses, the sheet included within the limitations has been used.

However, recently, it has been required that the sheet treatment such as the recording is effected on various sheets having various conditions. In this regard, in the conventional sheet supplying apparatuses, if any sheet having a condition exceeding the limitation is used, the poor sheet separation and/or poor sheet supply will frequently occur. Further, since the kinds of sheets to be used are limited, the efficiency of the sheet treating apparatus of the recording apparatus is reduced.

SUMMARY OF THE INVENTION

The present invention intends to eliminate the above-mentioned conventional drawback, and has an object to provide a sheet supplying apparatus in which sheets can positively be separated and supplied one by one regardless of a condition of the sheet such as a kind of sheet which can be used, thickness and rigidity of the sheet, a bending feature (flexion) of the sheet and/or the like.

To achieve the above object, according to the present invention, there is provided a sheet supplying apparatus comprising a sheet stacking means for stacking a plurality of sheets, a sheet supply means for feeding out the sheets stacked on the sheet stacking means, a separation means for separating the sheets one by one by abutting the sheets against the separation means to cause elastic angular change in the sheet thereby to ride the sheet over the separation means, and a guide means having a guide surface for guiding the sheet separated by the separation means toward a downstream side. Wherein the sheet stacking means is provided at its downstream end with a projecting portion which can protrude downwardly from the separation means and the guide means.

DETAILED DESCRIPTION OF THE PREFERRED EMBODIMENTS

Figure 1:
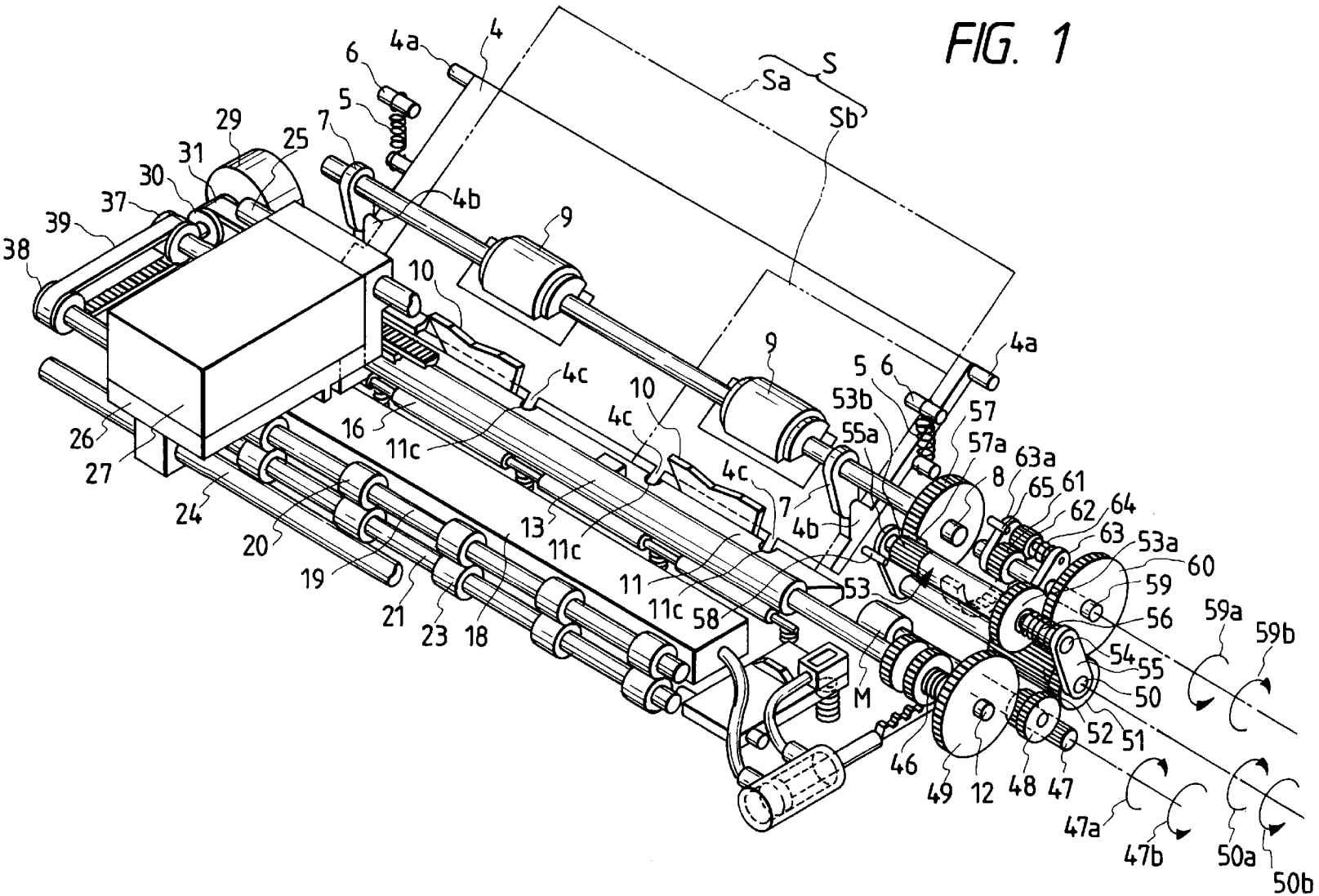
FIG. 1 is a perspective view of a recording apparatus having a sheet supplying apparatus according to the present invention.
Figure 2:
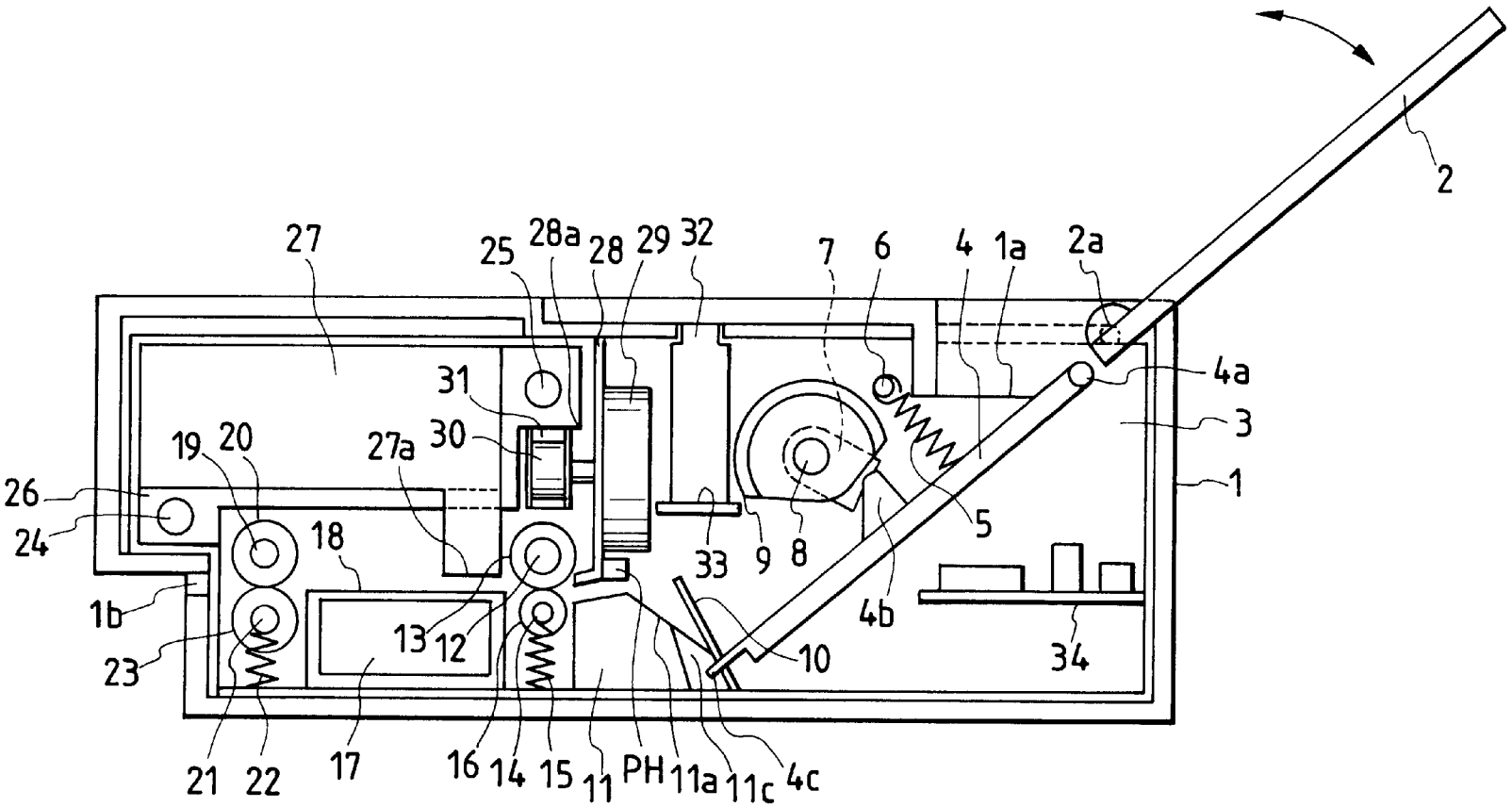
FIG. 2 is an elevational sectional view of the recording apparatus of FIG. 1.

FIGS. 1 and 2 show an embodiment in which the present invention is applied to an ink jet printer having an ink jet recording means, where FIG. 1 is a schematic perspective view of the printer and FIG. 2 is a sectional view of the printer.

In FIGS. 1 and 2, a cover 1 and a lid 2 pivotally mounted on a shaft 2*a* define an outer surface of the printer. The 11*d* 2 also acts as a sheet tray. Sheets are inserted through an insertion opening 1*a* formed in the cover 1 and are discharged through a discharge opening 1*b*. Inside a plurality of side plates 3 disposed within the cover 1, there are disposed a sheet stacking plate (sheet stacking means) 4 having a plurality of projections 4*c* and having one end biased around a shaft 4*a* (upwardly) toward a sheet supply roller 9 by a spring 5 secured to a pin 6, a sheet supply roller (sheet supply means) 9 secured to a shaft 8 and having a larger radius portion capable of contacting with the sheet and a smaller radius portion which does not contact with the sheet, drive cams 7 secured to the shaft 8 and capable of engaging with follower portions 4*b* (provided on left and right ends of the sheet stacking plate 4) to lower the sheet stacking plate 4 downwardly, abutment members (separation means) 10 acting as separation members for separating the sheets by abutting the sheets (supplied by the sheet supply roller 9) against the abutment members to cause angular change in the sheet thereby to separate the sheets, and a guide member (guide means) 11 having a surface 11*a* for directing a tip end of the sheet (separated by the abutment members 10) upwardly and transverse notches 11*c* into which the projections 4*c* can be inserted and adapted to separate the sheet from tip ends of the abutment members 10 by the directing action of the surface 11*a*. The guide member 11 will be fully described later.

Further, at a downstream side of the guide member 11, there are disposed a photo-sensor (sheet detection means) PH having a light emitting portion and a light receiving portion and adapted to detect tip and trail end of the sheet on the basis of presence/absence of reflected light, a convey roller (convey means) 13 secured to a shaft 12 and adapted to convey the sheet (supplied by the sheet supply roller 9 while being guided by an upper guide 28*a* and the guide member 11) at a constant speed, first pinch rollers 16 rotatably mounted on a shaft 14 and adapted to urge the sheet against the convey roller 13 by forces of springs 15 acting on the pinch rollers via the shaft 14, a platen 18 incorporating an ink absorbing material 17 therein, a sheet discharge roller 20 secured to a shaft 19 and adapted to discharge a printed sheet, second pinch rollers 23 rotatably mounted on a shaft 21 and adapted to urge the sheet against the discharge roller 20 forces of springs 22 acting on the pinch rollers via the shaft 21, a carriage 26 guided by guide shafts 24, 25 to be shifted in a width-wise direction of the sheet, and a recording head 27 mounted on the carriage 26 and adapted to effect the recording by discharging ink from a discharging portion 27*a* in response to image information.

The carriage 26 is driven by a motor 29 provided on a central side plate 28 having the upper guide 28*a*, a pulley 30 secured to an output shaft of the motor, and a belt 31 having one end secured to the carriage 26 and mounted on the pulley 30. Further, within the case 1, there are appropriately disposed an operation electric substrate 33 having a plurality of switch buttons 32 protruded from holes of the case, and a control electric substrate (control means) 34 including a microcomputer and memories and adapted to control an operation of the printer.

Next, a construction of the printer will be further explained with reference to FIG. 1. First of all, a switching means for controlling engagement and disengagement between the sheet stack rested on the sheet stacking plate 4 and the sheet supply roller 9 will be described.

The drive cams (cam members) 7 secured to the shaft 8 of the sheet supply roller 9 are contacted with the follower portions 4*b* of the sheet stacking plate 4 at predetermined positions by means of the forces of the springs 5. When the drive cams 7 are rotated in synchronous with the sheet supplying rotation of the sheet supply roller 9, the sheet stacking plate 4 is lifted or lowered, so that the engagement or disengagement between the sheet stack S rested on the sheet stacking plate and the sheet supply roller 9. Since a pulley 38 provided on one end of the shaft 12 of the convey roller is connected to a pulley provided on one end of the shaft 19 of the discharge roller through a belt 39, a rotational force of a motor (drive source) M is transmitted to the discharge roller 20 via the shaft 12.

Next, a construction of a drive transmitting means for transmitting the rotational force of the motor M to the sheet supply roller 9 and the convey roller 13 will be explained.

In response to a signal from a controller 34, the motor M drives (rotates) the pair of convey rollers 13, 16 through an output gear 47 provided on a motor shaft of the motor, a two-stage gear 48 and a convey roller gear 49 secured to the shaft 12, thereby conveying the sheet. Further, the motor M rotates the output gear 47, two-stage gear 48, and gear 51 secured to a shaft 50. A first planetary gear 53 meshed with a first sun gear 52 secured to the shaft 50 comprises a large planetary gear 53*a* and a small planetary gear 53*b*, and a shaft 54 of the first planetary gear 53 is rotatably supported by a first carrier 55 rotated around the shaft 50.

Since the first planetary gear 53 is urged against one of arm members 55*a* of the first gear by a spring 56 mounted on the shaft 54, the first planetary gear 53 is subjected to a predetermined load during its rotation.

When the output gear 47 of the motor M is rotated in a direction shown by the arrow 47*a*, the first sun gear 52 is rotated in a direction shown by the arrow 50*a*. Since the large planetary gear 53*a* meshed with the first sun gear 52 is subjected to a predetermined load during its rotation, the first planetary gear 53 is not rotated but is revolved around the first sun gear 52 in the direction 50*a*. Due to this revolution, since the first carrier 55 is also rotated in the direction 50*a*, the small planetary gear 53*b* is engaged by a gear 57 secured to the shaft 8 of the sheet supply roller, with the result that the rotational force (in the direction 47*a*) of the motor M is transmitted to the shaft 8, thereby rotating the sheet supply roller 9 in a sheet supplying direction 8*a*. The gear 57 has a non-toothed portion 57*a*, so that, during the rotation of the gear 57, when the non-toothed portion 57*a* is opposed to the small planetary gear 53*b*, the small planetary gear 53*b* is idly rotated not to transmit the rotation to the gear 57. As a result, the rotation of the gear 57 and the rotation (in the sheet supplying direction) of the sheet supply roller 9 are stopped.

Figure 4:
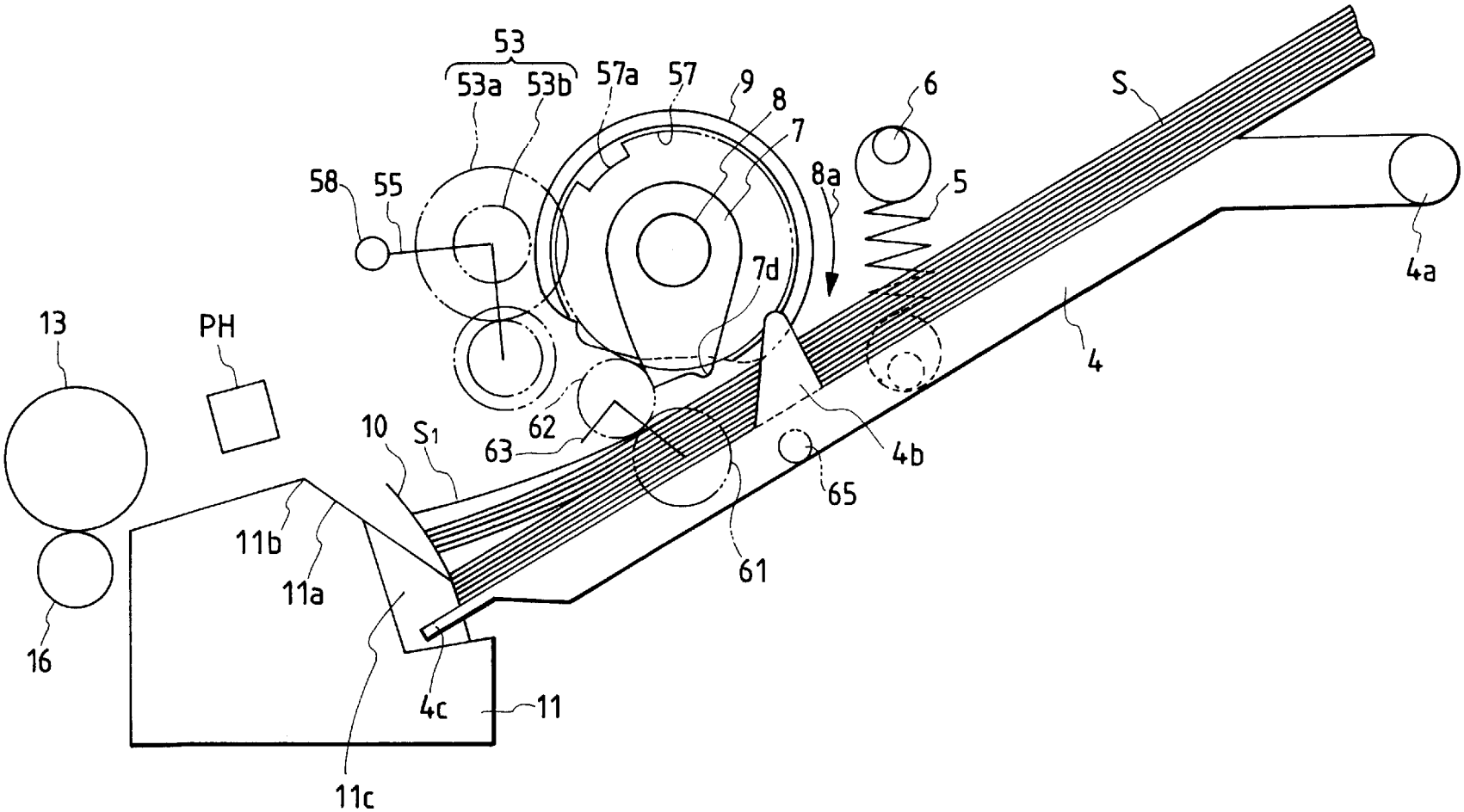
FIG. 4 is a side view of the sheet supplying apparatus during separation.

In FIGS. 1 and 4, when the motor M is rotated in a direction shown by the arrow 47*b*, the sun gear 52 is rotated in a direction shown by the arrow 50*b*. In synchronous with this rotation, the first carrier 55, 55*a* is rotated together with the first planetary gear 53 in the direction 50*b*. When the first carrier 55 is rotated in the direction 50*b*, the small planetary gear 53*b* is disengaged from the gear 57, with the result that the arm member 55*a* of the carrier abuts against a pin 58, thereby stopping the first carrier 55. At a position where the first carrier 55 is stopped, while the first sun gear 52 is being rotated in the direction 50*b*, the small planetary gear 53*b* continues to rotate idly.

A gear 60 meshed with the first sum gear 52 and a second sun gear 61 are secured to a shaft 59. A second planetary gear 62 meshed with the second sun gear 61 is rotatably supported by a second carrier 63 which can freely be rotated around the shaft 59. Since the second planetary gear 62 is urged against one of arm members 63*a* of the second carrier with predetermined pressure by means of a spring 64, the second planetary gear 62 is subjected to a predetermined load during its rotation.

When the motor M is rotated in the direction 47*a*, the gear 60, shaft 59 and second sun gear 61 are rotated in a direction shown by the arrow 59*a*. In response to such rotation, the second carrier 63 is also rotated in the direction 59*a* together with the second planetary gear 62. When the arm member 63*a* of the carrier abuts against a pin 65, the rotation of the second carrier 63 is stopped. In a condition that the second carrier 63 is stopped, during the further rotation of the sun gear 61, the second planetary gear 62 continues to rotate idly.

When the motor M is rotated in the direction 47*b*, the sun gear 61 is rotated in a direction shown by the arrow 59*b*. In response to this rotation, the second carrier 63 is also rotated in the direction 59*b* together with the second planetary gear 62, thereby engaging the second planetary gear 62 by the nontoothed gear 57. As a result, the rotation (in the direction 59*b*) of the second sun gear 61 is transmitted via the shaft 8 as the rotation (in the sheet supplying direction) of the sheet supply roller 9. As the gear 57 is further rotated by the second planetary gear 62, when the non-toothed portion 57*a* of the gear 57 is opposed to the second planetary gear 62, the second planetary gear 62 is idly rotated. With the result that, since the rotation is not transmitted to the gear 57, the rotation of the sheet supply roller 9 is stopped.

Next, in the embodiment shown in FIGS. 1 and 2, a sheet supplying operation and a recording operation will be explained in connection with a case where thick sheets or sheets having tip ends flexed upwardly are used. FIGS. 3 to 7 are sectional views showing main elements for supplying the sheet in FIG. 1. Now, the case where the thick sheet is supplied will be described.

Figure 3:
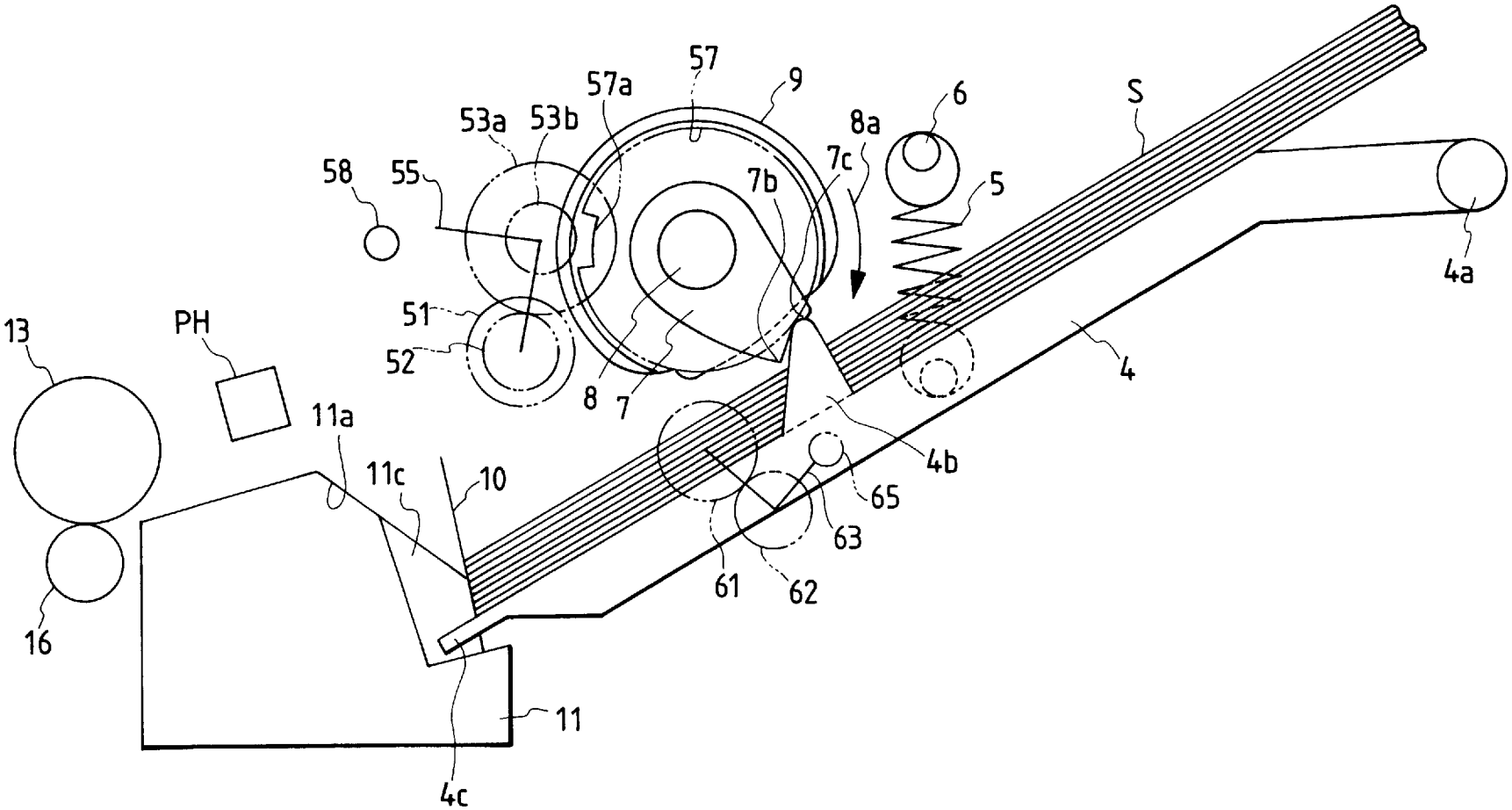
FIG. 3 is a side view of the sheet supplying apparatus before separation.

First of all, as an initializing operation, upon turning a power source ON, when the motor M shown in FIG. 1 is rotated in the direction 47*a* by a predetermined amount (i.e., when the convey roller 13 is rotated by a predetermined amount to convey the sheet S in a sub-scan direction toward the discharge opening 1*b* shown in FIG. 2) in response to initialization command from the controller 34 shown in FIG. 2, a condition that the rotational force of the motor M is not transmitted to the sheet supply roller 9 is established, and the sheet supplying portion assumes a position shown in FIG. 3. In FIG. 3, when stop position lift surfaces 7*b* of the drive cams 7 are engaged by the follower portions 4*b* of the sheet stacking plate 4 by the forces of the springs 5, the sheet stacking plate 4 is held at a lowered position. In this condition, a plurality sheets S are stacked on the sheet stacking plate 4 with tip ends (of the sheets) abutting against lower portions of the abutment members 10.

In FIG. 4, when the motor M is rotated in the direction 47*b* by a predetermined amount in response to sheet supply command from the controller 34, the second planetary gear 62 is revolved from a position where the second carrier 63 abuts against the pin 65 to a position where the second planetary gear is engaged by the gear 57. In this engaged position, since the second planetary gear 62 transmits the rotation (in the direction 47*b*) of the motor M to the gear 57, the sheet supply roller 9 starts to rotate in the sheet supplying direction 8*a* via the shaft 8. On the other hand, when the motor M is rotated in the direction 47*b*, the first planetary gear 53 is rotated around the first sum gear 52 in the direction 50*b* to be left from the engaged position for the gear 57.

Due to the rotation of the gear 57, since the drive cams 7 secured to the shaft 8 are rotated in the direction 8*a*, the stop position lift surfaces 7*b* of the drive cams 7 are disengaged from the follower portions 4*b* of the sheet stacking plate 4, with the result that the sheet stacking plate 4 is lifted by the pulling forces of the springs 5. When the sheet stacking plate 4 is lifted, since an uppermost sheet $S_1$, in the sheet stack S is urged against the rotating sheet supply roller 9, the uppermost sheet $S_1$ is supplied toward the abutment members 10. When the moving sheers S abut against the abutment members 10, angles of the abutment members 10 are changed in a sheet advancing direction by the moving force of the sheets S.

Figure 5:
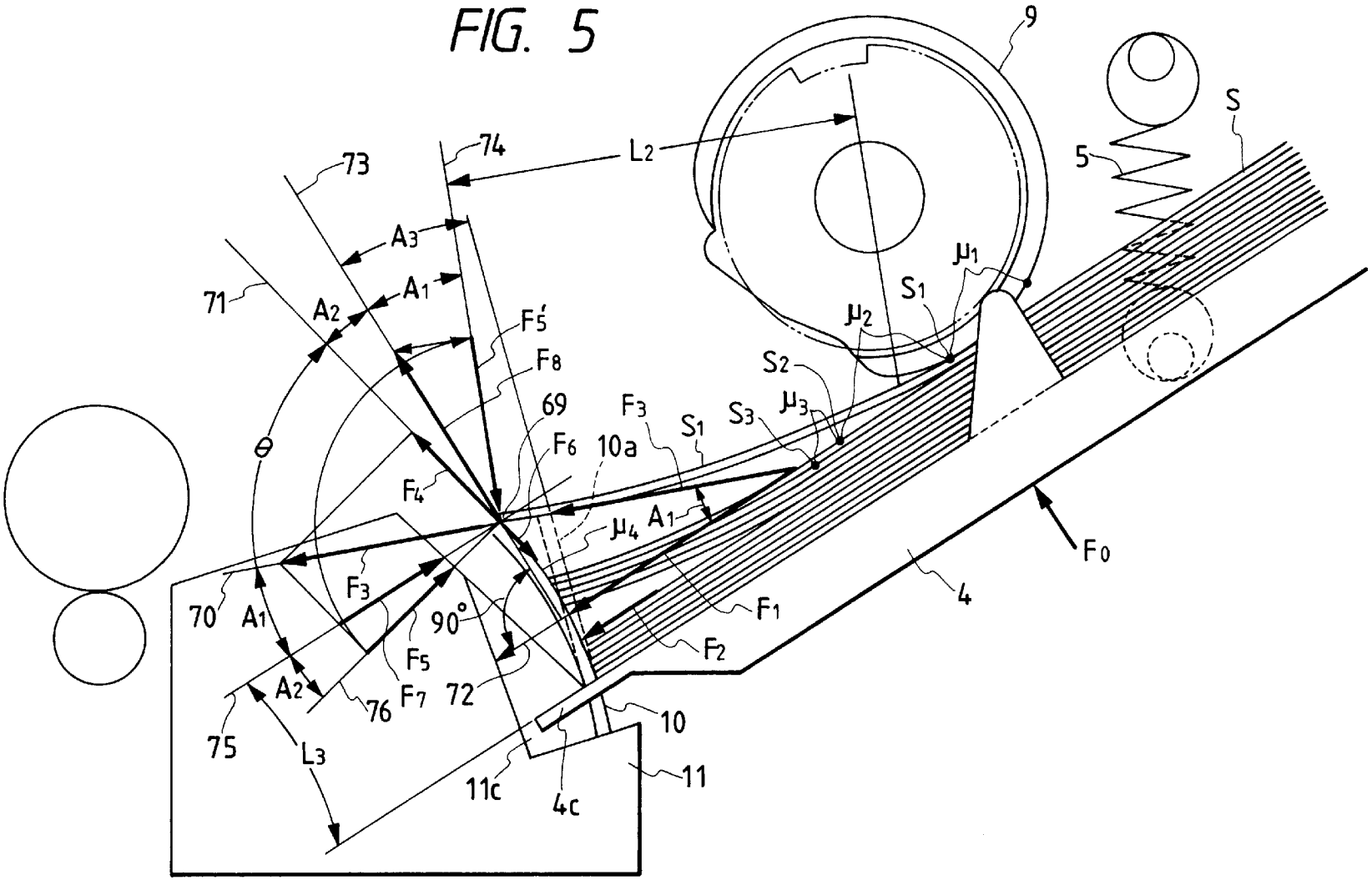
FIG. 5 is a side view of the sheet supplying apparatus during separation, showing a relation between various forces.

FIG. 5 shows a condition that, after the sheet supply roller 9 shown in FIG. 4 is further rotated to further advance the uppermost sheet $S_1$, a tip end of the uppermost sheet $S_1$ is aligned with tip ends of the abutment members 10 to establish a balanced condition. Two left and right sheet supply roller portions of the sheet supply roller 9 are made of chloroprene rubber or nitrile rubber or silicone rubber having high coefficient of friction, and the sheet stack S rested on the sheet stacking plate 4 is urged against the two sheet supply roller portions 9 by the forces of the springs 5 with an urging force of $F_0$.

A coefficient of friction between the sheet supply roller 9 and the uppermost sheet $S_1$is $\mu_1$, a coefficient of friction between the uppermost sheet $S_1$ and a second sheet $S_2$ is $\mu_2$, a coefficient of friction between the second sheet $S_2$ and a third sheet $S_3$ is $\mu_3$, and so on. There is a relation $\mu_1 >> \mu_2$ between the coefficients $\mu_1$ and $\mu_2$ of friction. Accordingly, when the sheet stack S rested on the sheet stacking plate 4 is urged against the sheet supply roller 9 by the forces of the springs 5 with the force $F_0$, the uppermost sheet $S_1$ abuts against the abutment members 10 with a moving force $F_1$ defined as follows:

$$F_1=F_0(\mu_1-\mu_2)$$

On the other hand, although a moving force $F_2$ of the second sheet and so on is defined as $F_2=F(\mu_2-\mu_3)$, since $\mu_2 \approx \mu_3$, the force $F_2$ is significantly smaller than the force $F_1$.

In FIG. 5, the uppermost sheet $S_1$ applies a force of $F_3=F_1 \cos A_1$ to the abutment members 10 to change the angles of the abutment members from a position 10*a* by an angle of $(A_2+A_3)$. At this point, the tip end of the sheet $S_1$ and the tip ends of the abutment members 10 is balanced at the position 69 by the elastic forces of these elements (sheet and abutment members), thereby stopping the movement of the sheet $S_1$.

When it is assumed that an urging force of the uppermost sheet $S_1$ acting on the abutment members 10 is $F_3$, a coefficient of friction between the tip end of the sheet $S_1$ and the abutment members 10 is $\mu_4$, and an angle between a tangential line 70 of the sheet $S_1$ at the position 69 and a tangential line 71 of the abutment members 10 at the position 69 is θ°, the sheet $S_1$ starts to slide on the abutment member at the following angle θ°:

$$F_4=F_3 \cos \theta^\circ$$

$$F_5=F_3 \sin\theta^\circ \quad (1)$$

$F_6=\mu_4 F_3 \sin \theta^\circ$, and, thus, $$F_4-F_6>0$$

$$F_3(\cos \theta^\circ-\mu_4 \sin \theta^\circ)>0$$

$$F_3(\tan \theta^\circ-\mu_4)>0$$

$$\theta^\circ > \tan^{1}\mu_4 \quad (2)$$

When an angle between a line 73 perpendicular to a supplying direction 72 and passing through the point 69 and a line perpendicular to the tangential line 70 and passing through the point 69 is $A_1$ [rad], the sheet $S_1$ is flexed at the following angle:

$$A_1 \approx F_8 L_2^2 K_1 \quad (3)$$

$$K_1=\tfrac{1}{2}\times E_1\times I_1 \quad (3)'$$

Where, $K_1$ is elasticity of the sheet $S_1$, $A_1$ is a slope of the sheet $S_1$, $L_2$ is a length of deflection of the sheet $S_1$, $E_1$ is Young's modules of the sheet $S_1$, and $I_1$ is moment of inertia of area of the sheet $S_1$. And, because of the above-mentioned balance, the following relation is established:

$$F_5'=F_5=F_8 \cos A_1^\circ \text{ (here, } A_1^\circ=A_1\times 180^\circ/\pi) \quad (4)$$

Further, when an angle between the perpendicular 73 and the tangential line 71 is $A_2$ [rad], the abutment members 10 are flexed at the following angle:

$$A_2 \approx F_7 L_3^2 K_2 \quad (5)$$

$$K_2=\tfrac{1}{2}\times E_2\times I_2\times n \quad (5a)$$

Where, $K_2$ is elasticity of the abutment members 10, $A_2$ is slopes of the abutment members 10, $L_3$ is length of deflection of the abutment members 10, $E_2$ is Young's modules of the abutment members 10, $I_1$ is moment of inertia of area of the abutment members 10 and n is the number of the abutment members. And, because of the above-mentioned balance, the following relation is established:

$$F_5=F_7 \cos A_2^\circ \text{ (here, } A_2^\circ=A_2\times 180^\circ/\pi) \quad (6)$$

On the other hand, an angle between a line segment 75 perpendicular to the perpendicular 73 and passing through the point 69 and the tangential line 70 becomes $A_1^\circ$, and an angle between the line segment 75 and a line segment 76 perpendicular to the tangential line 71 becomes $A_2^\circ$. Therefore, the following relation is established:

$$\theta^\circ+A_1^\circ+A_2^\circ\approx 90^\circ \ (=\pi/2 \text{ [rad]}) \quad (7)$$

In the balanced condition, since $F_3 \sin\theta^\circ=F_8 \cos A_1^\circ=F_7 \cos A_2^\circ$, from the above equations (1), (4) and (6), a force $F_3$ in the balanced condition can be represented as follows:

$$F_3=F_8 \cos A_1^\circ/\sin\theta^\circ=F_7 \cos A_2^\circ/\sin\theta^\circ \quad (8)$$

Accordingly, when the sheet $S_1$ is subjected to a moving force (greater than the force $F_3$ determined by the above equation (6)) from the sheet supply roller 9, the tip end of the sheet $S_1$ rides over the tip ends of the abutment members 10 to be completely separated from the second and other sheets $S_2$, $S_3$, . . . .

Since the angle θ° is determined only by the coefficient $\mu_4$ of friction from the above relation (2), from the above equation (5), the following relation is established:

$$A_1^\circ+A_2^\circ\approx 90^\circ-\theta^\circ=\text{constant} \quad (9)$$

The value of elasticity $K_1$ of the sheet $S_1$ included in the above equation varied greatly in dependence upon the kind of the sheet S. For example, when it is assumed that the elasticity if a thin sheet having a thickness of 0.065 mm is $K_{1-a}$ and the elasticity of a post card or an envelope is $K_{1-b}$, the following relation is established:

$$K_{1-b}/K_{1-a}\approx 13 \quad (10)$$

In case of thin sheet, regarding the angle θ° in the above equation (9), $A_1^\circ >> A_2^\circ$ is established. That is, the separation of the thin sheet greatly depends upon the slope of the sheet itself. On the other hand, in case of the thick sheet such as a post card, $A_1^\circ \geqq A_2^\circ$ is established. That is, the separation of the thick sheet greatly depends upon the slopes of the abutment members 10. During the sheet separation, in order to prevent the double-feed of the second and other sheets, it is necessary to reduce the value of $A_2^\circ$ in the equation (9) as small as possible. Although the angle $A_1^\circ$ in the equation (3) is greatly varied in accordance with the value $K_1$ to satisfy the equation (10); on the other hand, since the length $L_2$ of deflection of the sheet S is varied with "square", by properly setting the value $L_2$, the influence of the equation (10) with respect to the slope $A_1$ can be reduced.

As the value $L_2$ is increased, the thick sheets can be separated more easily because the slope $A_1$ of the sheet is increased, but, regarding the thin sheets, the double-feed of the second and other sheets frequently occur. As the value $L_2$ is decreased, the thin sheets obtain a profit because of the small slope $A_1$, but, regarding the thick sheets, since it becomes hard to deflect (flex) the sheet, the double-feed of the second other sheets will frequently occur. From the above, it was found that good sheet separation can be obtained by selecting $L_2$=15 to 25 mm in a range that the elasticity $K_1$ of the sheet S satisfies the above equation (10).

Figure 6:
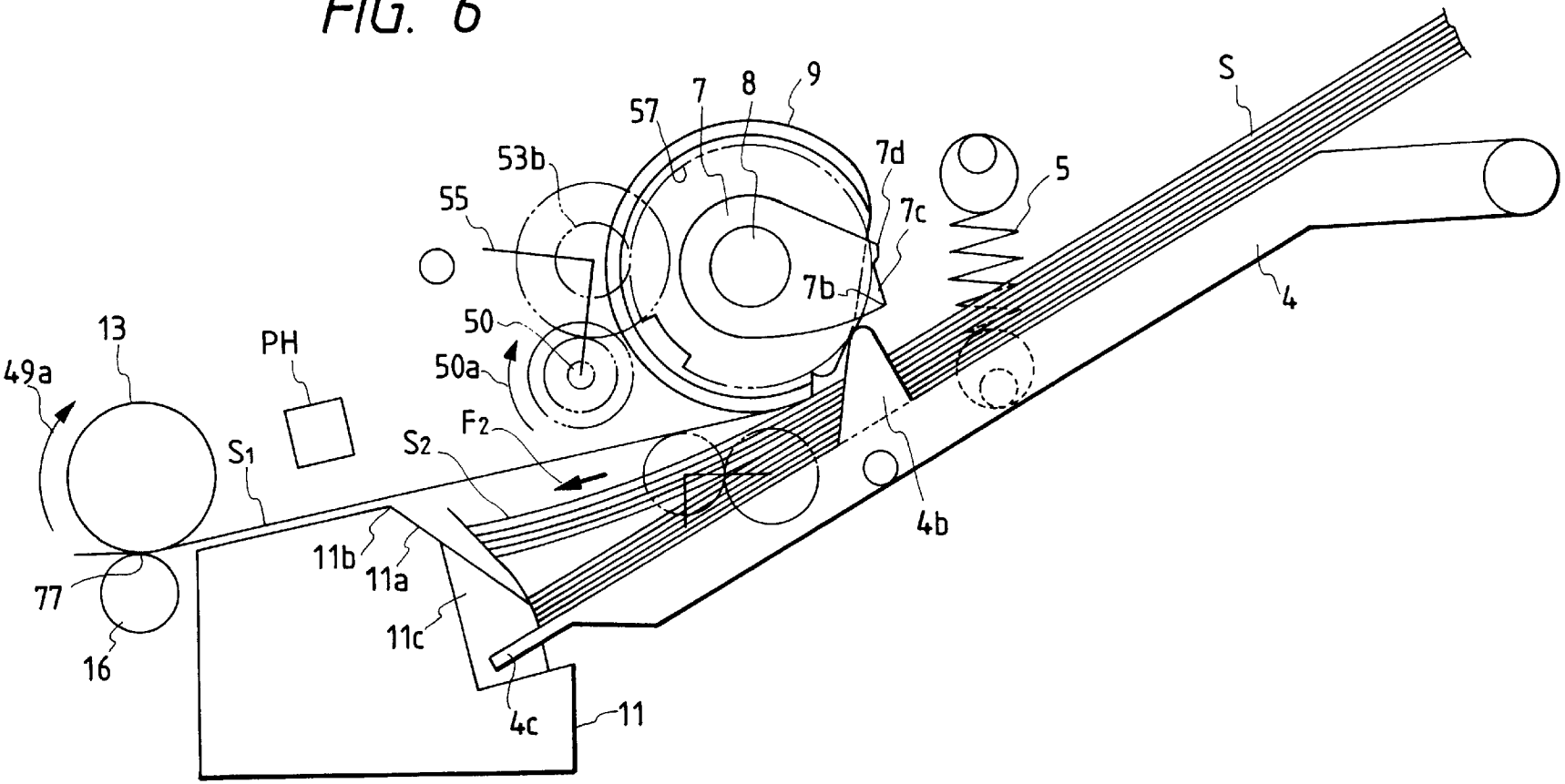
FIG. 6 is a side view of a drive transmitting mechanism of the sheet supplying apparatus in a condition that a reverse rotation condition is changed to a normal rotation condition.

In FIG. 6, the tip end of the sheet $S_1$ exceeding beyond the tip ends of the abutment members 10 is directed upwardly by the inclined surface 11*a* of the guide member 11, thereby lifting the tip end of the sheet $S_1$. As a result, the tip end of the sheet $S_1$ exceeds beyond a top 11*b* of the guide member and is shifted toward a nip between the convey roller 13 and the first pinch rollers 16. The convey roller 13 is rotated in the direction 49*a* by the rotation of the gear 47. On the other hand, at the same time, since the carrier 55 is rotated around the shaft 50 toward the direction 50*a*, the small planetary gear 53*b* of the first planetary gear 53 is instantaneously engaged by the gear 57. As a result, the sheet supply roller 9 is rotated in the sheet supplying direction to push the tip end of the sheet $S_1$ into the nip 77 between the convey roller 13 and the first pinch rollers 16. The tip end of the sheet $S_1$ entered into the nip passes through the nip 77 by the rotation of the convey roller 13.

Till the sheet $S_1$ passes through the nip 77, since the sheet supply roller 9 is being rotated while urging the upper surface of the sheet $S_1$, as explained in connection with FIG. 5, the moving force $F_2$ sufficiently smaller than the force $F_1$ acts on the second and other sheets $S_2$, $S_3$, . . . . In the change in angle of the abutment members 10 effected by the moving force $F_2$, since the angle θ° in the above equation (2) becomes to satisfy the following relation (11) at the position where the sheet $S_2$ abuts against the abutment members 10, the tip ends of the second and other sheets $S_2$, $S_3$, . . . do not slide on the surfaces of the abutment members 10, and, thus, these tip ends do not exceed beyond the tip ends of the abutment members.

On the shaft 8, the gear 57, regarding the angular phases of the drive cams 7 and sheet supply roller 9, a predetermined phase relation between these elements is maintained. Further, each drive cam 7 includes a drive lift surface 7*a*, a maximum lift surface 7*b*, a stop position lift surface 7*d* having a lift amount smaller than that of the maximum lift surface 7*b*, and an inclined surface 7*c* connecting between the maximum lift surface 7*b* and the stop position lift surface 7*d*.

Due to the rotation of the small planetary gear 53*b* of the first planetary gear 53, the drive cams 7 are rotated in the direction 8*a* through the gear 57 and the shaft 8. During this rotation, the drive lift surfaces 7*a* are engaged by the follower portions 4*b* provided on left and right ends of the sheet stacking plate 4, with the result that the sheet stacking plate 4 is rotated downwardly around the shaft 4*a* by the rotation of the drive cams 7 in opposition to the forces of the springs 5. As a result, the upper surface of the sheet stack S rested on the sheet stacking plate 4 is released from the sheet supply roller 9 not to be subjected to any urging force. Thus, the second and other sheets $S_2$, $S_3$, . . . can easily be shifted in a direction opposite to the sheet supplying direction. Accordingly, the second and other sheets $S_2$, $S_3$, . . . follow the downward rotation of the sheet stacking plate 4 while shifting to the opposite direction by restoring forces of the abutment members 10.

When the second and other sheets $S_2$, $S_3$, . . . are shifted in the opposite direction, since any sheet does not act on the abutment members 10, the abutment members 10 is restored to their original position where there is no angular change. In this way, the load acting on the abutment members 10 is released.

Figure 7:
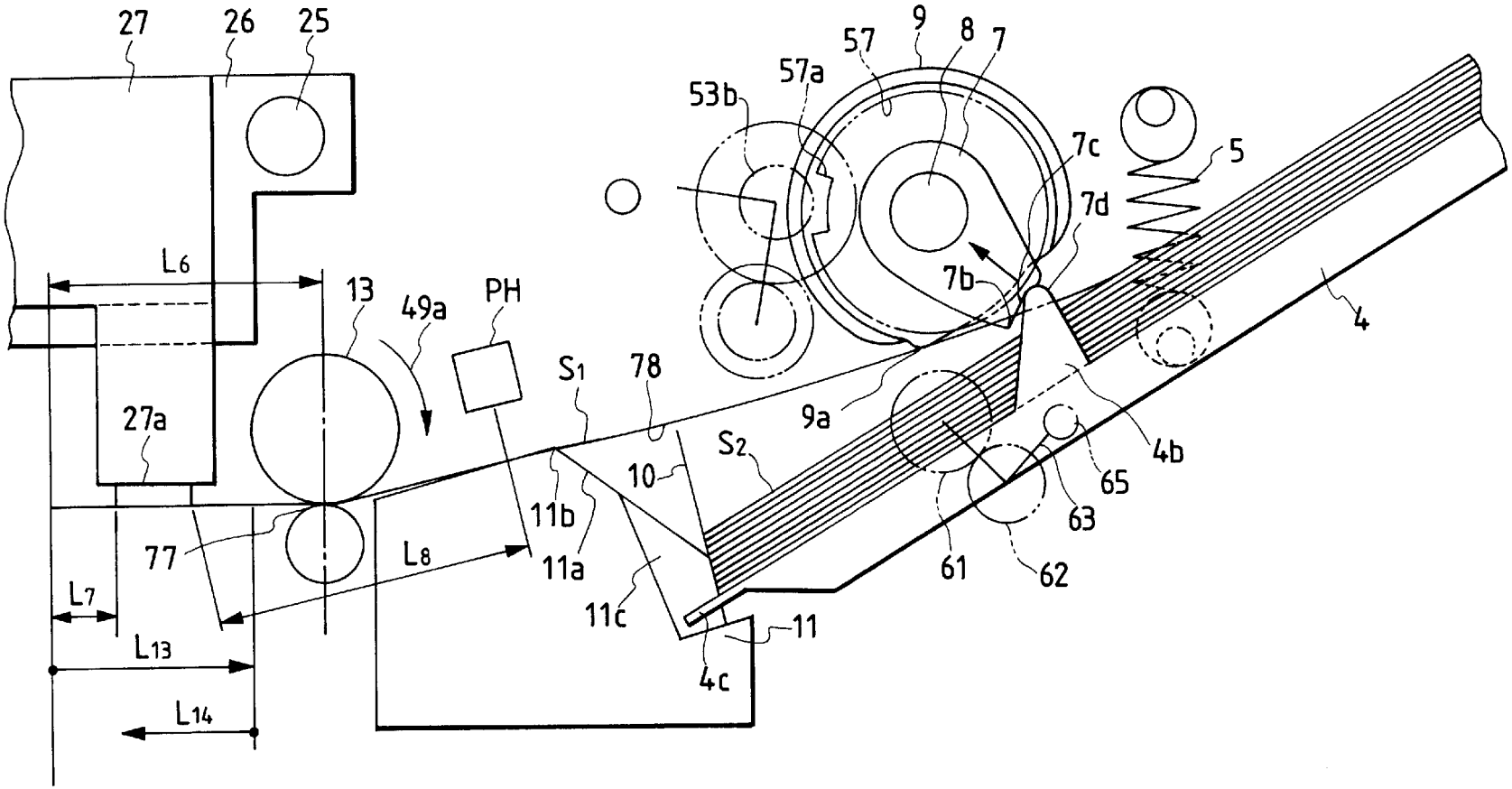
FIG. 7 is a side view of the sheet supplying apparatus, showing a condition that, after a sheet supply roller is separated from a sheet, the sheet is positioned at a recording position.

In a condition, shown in FIG. 7, that the urging force acting on the upper surface of the sheet stack S is released, the sheet $S_1$ is prevented from flexed downwardly (from the predetermined position) by the presence of the top 11*b* of the guide member 11. That is to say, the positions of the top 11*b* and of the tip ends of the abutment members 10 are selected so that a predetermined clearance 78 is created between the lower surface of the regulated sheet $S_1$ and the tip ends of the abutment members 10. By providing such clearance 78, when the abutment members 10 are returned to their original positions, the tip ends of the abutment members 10 do not interfere with the sheet $S_1$, thereby surely returning the abutment members. Further, by providing such clearance 78, any noise which would be generated by the interference between the moving uppermost sheet $S_1$ and the abutment members 10 can be prevented.

Incidentally, in the sheet supply means using the sheet supply roller 9 including the large radius portion and the small radius portion, after the sheet is fed out by the large radius portion having high friction surface (such as rubber) and contacting with the surface of the sheet, the small radius portion is opposed to the sheet stack. Since the small radius portion has protruded flange portions 9*a* having low coefficient of friction and a retarded or retracted high friction surface, after the sheet is fed out to be conveyed by the convey roller 13, when the small radius portion is opposed to the sheet stack, the deflection amount of the sheet is reduced by a difference in length between the large radius portion and the small radius portion. At the same time, the flange portions 9*a* are contacted with the upper surface of the sheet being conveyed, thereby guiding the sheet while preventing the floating of the sheet. In this case, since the flange portions 9*a* is made of material having low coefficient of friction, the resistance to the sheet conveyance is reduced and the fluctuation of the load acting on the motor M serving as a drive source for the convey roller 13 is also reduced, thereby improving the sheet conveying accuracy of the convey roller 13.

In FIG. 7, at the same time when the maximum lift surfaces 7*b* of the drive cams 7 leave the abutment portions 46*a* of the follower portions 4*b*, since the non-toothed portion 57*a* of the gear 57 is opposed to the small planetary gear 53*b* of the first planetary gear 53, the transmission of the rotational force from the small planetary gear 53*b* to the gear 57 is interrupted, thereby stopping the gear 57 and the sheet supply roller 9. When the motor M is rotated by the number $P_4$ of pulses corresponding to the distance $L_6$, the tip end of the sheet $S_1$ is conveyed by the convey roller 13 up to a position advancing from the nip 77 by the distance $L_6$. The distance $L_6$ is set by the controller 34 so that the recording position of leading nozzles of the ink discharge portion 27*a* of the recording head 27 is spaced apart from the tip end of the sheet $S_1$ by the predetermined distance $L_7$.

Figure 12:
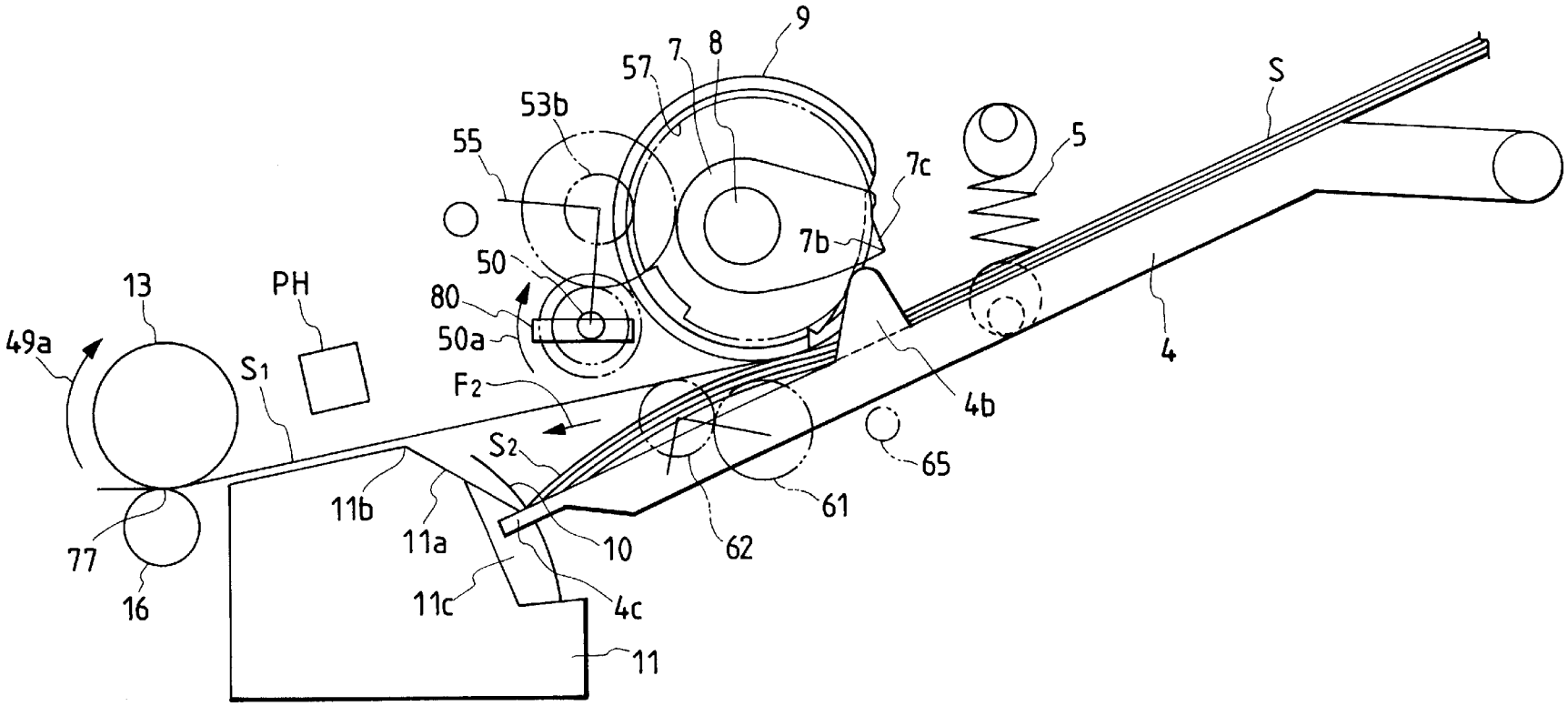
FIG. 12 is a side view of the sheet supplying apparatus, showing a condition after the sheet having downwardly-flexed end was separated.

An operator can input the value of $L_7$ (for example, 1.5 mm or 3 mm) to the controller 34 through a computer connected to the printer. While the tip end of the sheet $S_1$ is being conveyed by the sheet supply roller 9 and the convey roller 13 up to the $L_6$ position, the abutment portions 46*a* of the follower portions 4*b* must be engaged by the stop position lift surfaces 7*a* of the drive cams 7. In FIG. 12, by reducing the distance $L_7$, if the lift surfaces 7*a* is not positively engaged by the abutment portions 46*a*, first of all, the distance $L_7$ is selected to have an adequate great value, and the sheet is conveyed by the distance $L_6$ in the normal direction. Then, the sheet is conveyed in a reverse direction by a predetermined distance $L_{13}$ ($L_6 > L_{13}$) by the reverse rotation of the convey roller 13, and, lastly, the sheet is conveyed in the normal direction by a record length distance $L_{14}$ by the rotation (in the direction 49*a*) of the convey roller 13.

In FIGS. 1 and 7, after the sheet $S_1$ was conveyed to the recording position of the recording head 27, a predetermined image is recorded on the sheet $S_1$ by discharging ink from the discharging portion 27*a* of the recording head 27 in response to the command from the controller 34 while reciprocally shifting the carriage 26 in a main scan direction. After one-line recording is finished, the motor M is controlled by the controller 34 to feed the sheet $S_1$ in the sub scan direction by one line.

By repeating such operations, the image or characters are recorded on the whole surface of the sheet $S_1$ by the recording head 27.

In FIGS. 1, 2 and 7, when the trail end of the sheet $S_1$ is detected by the photo-sensor PH, the controller 34 guesses the distance $L_8$ from the detection position of the photo-sensor PH to rear nozzles of the ink discharging portion 27*a* and causes the recording head 27 to effect the recording within the distance $L_8$. Then, the convey roller 13 and the discharge roller 20 are continuously rotated by a predetermined amount, thereby discharging the sheet $S_1$ through the discharge opening 1*b* shown in FIG. 2. After the discharge roller 20 is continuously rotated by the predetermined amount, when the next sheet supply requirement is inputted to the controller 34 through the computer, the supplying operation of the next sheet S is started.

Incidentally, in the illustrated embodiment, while an example that the thick sheets are separated and supplied was fully explained, any sheets having tip ends deflected upwardly can be separated and supplied in the same manner as mentioned above.

Next, the sheet supplying operation when very thin sheets are used or sheets having tip ends deflected downwardly will be explained with reference to FIGS. 8 to 12. FIGS. 8 to 12 are side views showing main elements for supplying the sheet shown in FIG. 1.

Figure 8:
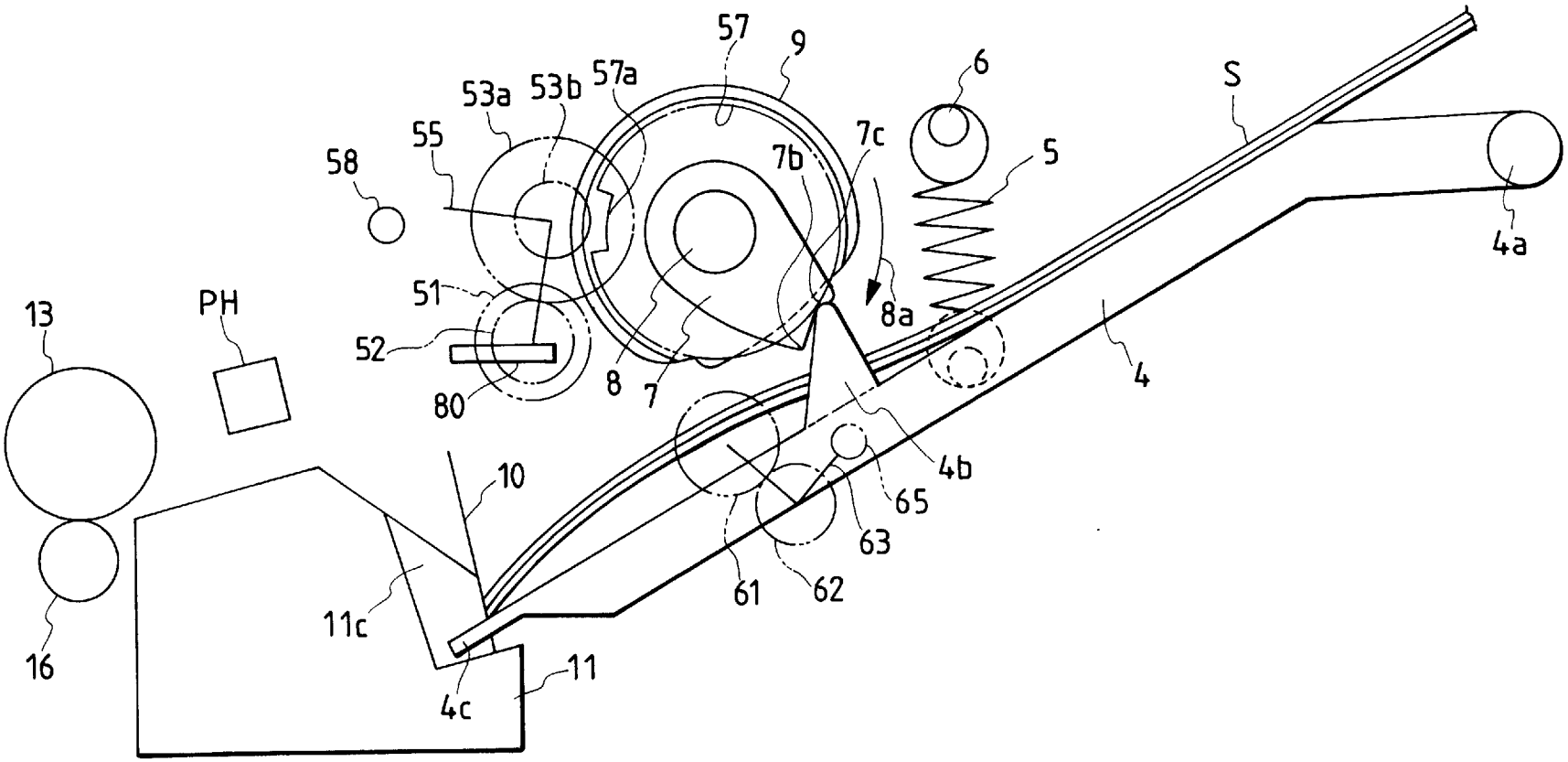
FIG. 8 is a side view showing a condition that the sheets having downwardly-flexed ends are stacked on the sheet supplying apparatus.

In FIG. 8, the sheet stacking plate 4 is held stationary at the lowered position by the above-mentioned initialization operation. In this condition, very thin sheets (having a thickness of 0.04 mm, for example) or sheets S having tip ends deflected downwardly are rested on the sheet stacking plate 4 while abutting the sheets against the abutment members 10. If a large number of sheets S having tip ends deflected downwardly are stacked on the sheet stacking plate, a central portion of the sheet stack is swollen or protruded upwardly to contact the upper surface of the sheet stack with the sheet supply roller 9, thereby causing the incorrect sheet supply. Thus, when the sheets having tip ends deflected downwardly are used, the number of sheets to be stacked on the sheet stacking plate is limited so that the upper surface of the sheet stack does not contact with the sheet supply roller 9.

Figure 9:
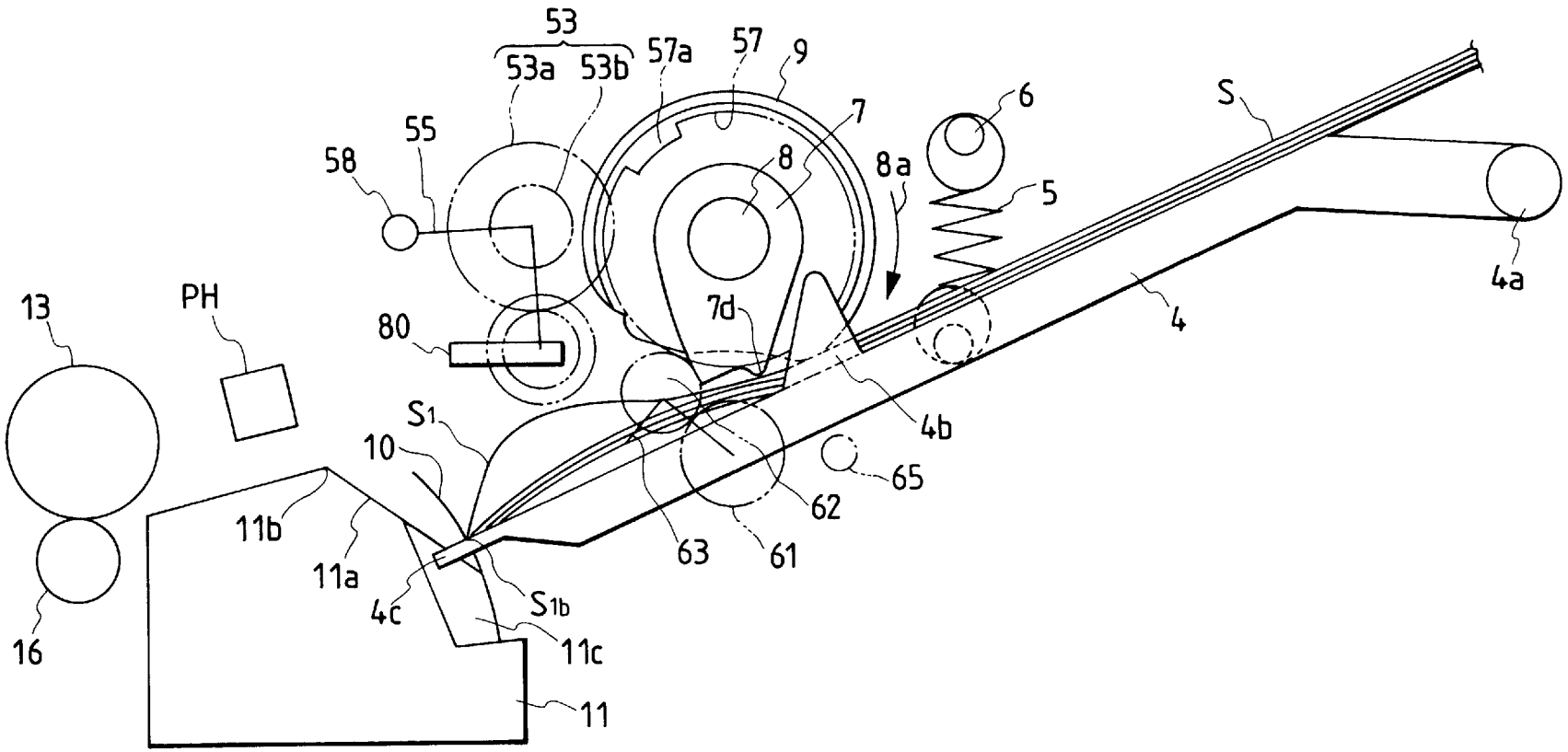
FIGS. 9, 10 and 11 are side views of the sheet supplying apparatus, showing a condition that the sheets having downwardly-flexed ends are being separated.

In FIG. 9, when the motor M is rotated in the direction 47*b* by a predetermined amount in response to the sheet supply command from the controller 34, the second planetary gear 62 is revolved from the position where the second carrier 63 abuts against the pin 65 to the engagement position where the second planetary gear is engaged by the gear 57. In the engagement position, since the second planetary gear 62 can transmit the rotation (in the direction 47*b*) of the motor M to the gear 57, the sheet supply roller 9 starts to rotate in the sheet supplying direction 8*a* through the shaft 8.

On the other hand, by the rotation of the motor M in the direction 47*b*, the first planetary gear 53 is rotated around the first sun gear 52 in the direction 50*b*, with the result that the first planetary gear leaves from the gear 57. Since the drive cams 7 second to the shaft 8 are rotated in the direction 8*a* by the rotation of the gear 57, the stop position lift surfaces 7*b* of the drive cams 7 are disengaged from the follower portions 4*b* of the sheet stacking plate 4, with the result that the sheet stacking plate 4 is lifted by the pulling forces of the springs 5.

When the sheet stacking plate 4 is lifted, since the uppermost sheet $S_1$ in the sheet stack S is urged against the rotating sheet supply roller 9, the uppermost sheet $S_1$ is supplied toward the abutment members 10. The left and right tip end portions of the sheet $S_1$ shifted by the moving force abuts against the abutment members 10 and the projections 4*c* of the sheet stacking plate 4 to regulate the shifting movement of the tip end, with the result that a front end portion of the sheet $S_1$ becomes upwardly-convex. In case of any sheet having low resiliency, a front end portion of the sheet similarly becomes upwardly-convex by the moving force generated by the rotation of the sheet supply roller 9 and the regulation of the projections 4*c* and the abutment members 10.

Figure 10:
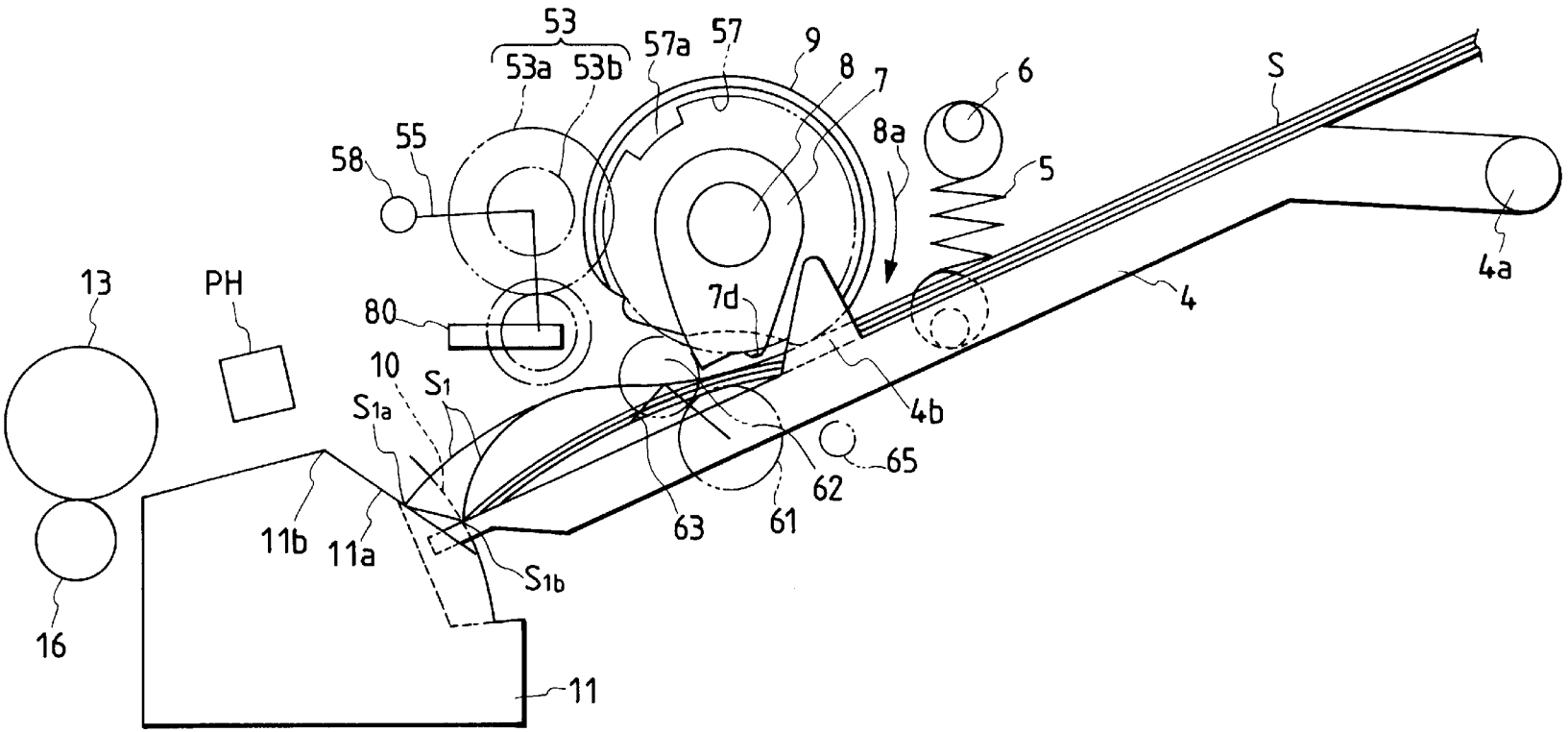

Now, a movement or performance of a front end central portion of the sheet $S_1$ in FIG. 9 will be explained with reference to FIG. 10. FIG. 10 is a sectional view of the sheet $S_1$ shown in FIG. 9. In FIG. 10, since the tip end central portion $S_{1a}$ of the sheet $S_1$ is not subjected to resistance from the abutment members 10, the tip end central portion $S_{1a}$ is protruded downstreamly more than the left and right tip end portions $S_{1b}$ and is shifted upwardly while contacting with the inclined surface 11*a* of the guide member 11.

Figure 11:
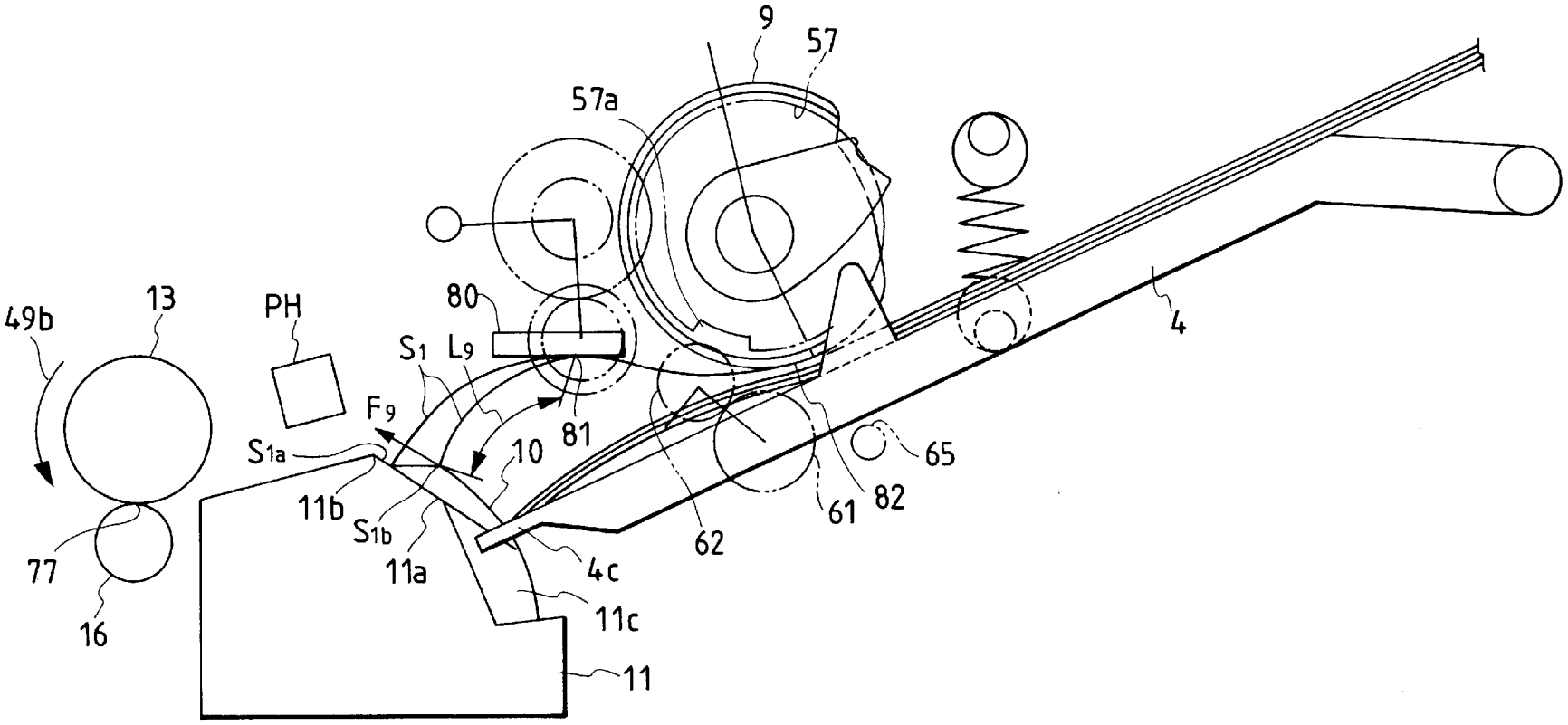

As shown in FIG. 11, when the sheet supply roller 9 is further rotated, the tip end central portion $S_{1a}$ of the sheet $S_1$ is further shifted upwardly while being guided by the inclined surface 11*a*. By the upward shifting movement of the tip end central portion $S_{1a}$, the left and right tip end portions $S_{1b}$ move up to the tip ends of the abutment members 10 while bending the abutment members. In this case, the left and right tip end portions $S_{1b}$ of the sheet $S_1$ urges the abutment members 10 with an elastic force of $F_9$ due to the deflection of the sheet between the sheet supply roller 9 and the tip end of the sheet.

In a condition before the left and right tip end portions $S_{1b}$ of the sheet $S_1$ ride over the tip ends of the abutment members 10, by providing a deflection regulating member 80 at a predetermined position corresponding to a top of convex deflection of the sheet $S_1$, a distance $L_9$ between the tip end of the sheet $S_1$ and a deflection support point 81 on the regulating member becomes shorter a distance from the tip end of the sheet and a contact position (original deflection support point) 82 between the sheet supply roller 9 and the sheet $S_1$, thereby increasing the elastic force $F_9$. That is to say, before the sheet $S_1$ abuts against the deflection regulating member 80, the deflection occurs entirely between the tip end of the sheet and the contact position 82 (between the sheet supply roller 9 and the sheet $S_1$); whereas, after the sheet abuts against the deflection regulating member 80, the deflection strongly occurs between the tip end of the sheet and the abutment position (deflection support point 81), thereby increasing the elastic force $F_9$.

In FIG. 12, while the tip end central portion $S_{1a}$ of the sheet $S_1$ is exceeding beyond the top 11*b* of the guide member 11, the left and right tip end portions $S_{1b}$ of the sheet $S_1$ ride over the tip ends of the abutment members 10, with the result that the entire tip end of the sheet exceeds beyond the top 11*b* and is shifted toward the nip between the convey roller 13 and the first pinch rollers 16. Then, the tip end of the moving sheet $S_1$. abuts against the nip 77 between the convey roller 13 and the first pinch rollers 16, with the result that the movement of the tip end of the sheet $S_1$ is stopped and the entire tip end of the sheet $S_1$ is contacted with the entire nip to be parallel to the latter, thereby correcting the skew-feed of the sheet.

After this process, the same sheet supplying and recording operations as mentioned in connection with FIGS. 6 and 7 are effected.

Next, a construction of the inclined surface of the guide member 11 will be explained.

Figure 13:
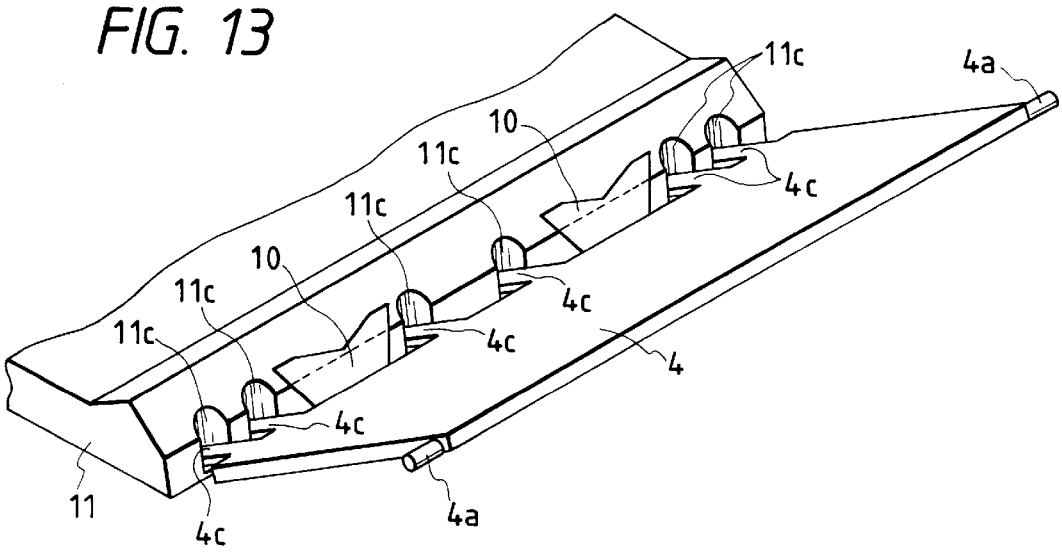
FIG. 13 is a perspective view showing a configuration of a guide member of the sheet supplying apparatus.

FIG. 13 is a perspective view showing main parts around the guide member 11. The guide member 11 has an inclined surface lla continuously extending in a width-wise direction of the sheet S to be guided, and a plurality of transverse notches 11*c* formed in the inclined surface 11*a*, and the plurality of projections 4*c* formed on the front end of the sheet stacking plate 4 are protruded into the transverse notches 11*c*. With this arrangement, even when the angles of the abutment members 10 are changed in any way, the tip end of the sheet $S_1$ shown in FIGS. 8 to 10 can positively abut against the projections 4*c*. Further, since the inclined surface 11*a* of the guide member 11 is extending continuously in the width-wise direction of the sheet, a continuous space is created below the inclined surface. By utilizing such space as a waste ink containing portion or the like, the printer can be made more compact.

Figure 14:
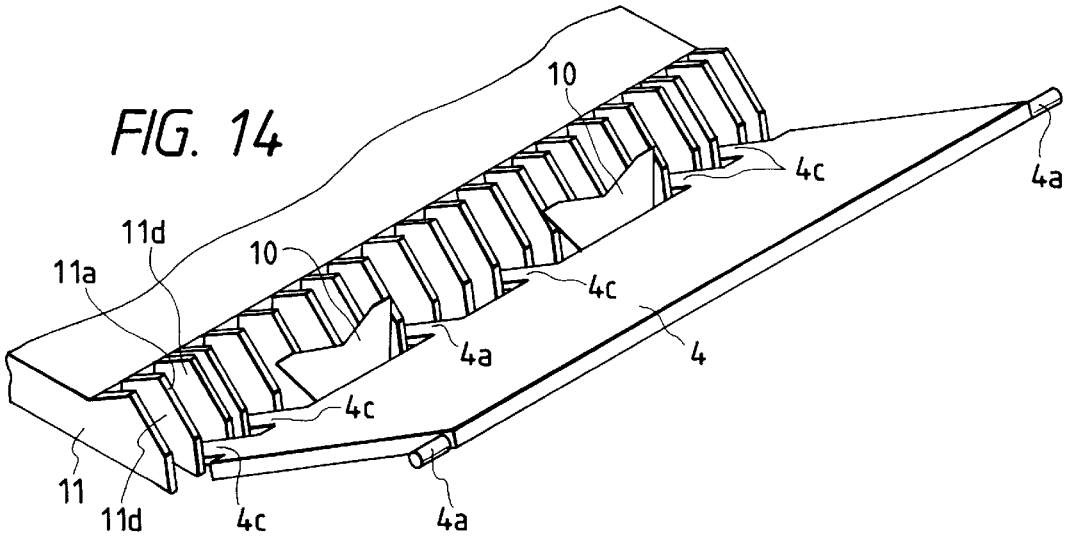
FIG. 14 is a perspective view of a configuration of a guide member according to another embodiment, in the sheet supplying apparatus.

FIG. 14 is a perspective view showing main parts around a guide member 11 according to another embodiment. In FIG. 14, the guide member 11 comprises a plate-shaped rib members 11*d* having inclined surfaces 11*a* of predetermined thickness arranged in parallel along the width-wise direction of the sheet S, and the projections 4*c* of the sheet stacking plate 4 are received between the rib members 11*d*. Accordingly, even when the angles of the abutment members 10 are changed in any way, the tip end of the sheet $S_1$ shown in FIGS. 8 to 10 can positively abut against the projections 4*c*.

Further, since each inclined surface 11*a* of each rib member 11*d* has merely a thickness of a few millimeters, the contact resistance between the guide member 11 and the sheet $S_1$ can be reduced in comparison with the continuous inclined surface. Due to the reduced contact resistance, the sheet $S_1$ can smoothly be guided toward the convey roller 13 by the plurality of guide members 11*d* without any trouble. Further, since the plurality of projections 4*c* can be received between the plurality of rib members 11*d* if necessary, the supplying and separating operation is further stabilized and improved.

As mentioned above, according to the sheet supplying apparatus of the present invention, various kinds of sheets can be used, sheets having various thicknesses can be handled, and even sheets having tip ends flexed upwardly or downwardly can positively be separated. By combining the sheet supplying apparatus according to the present invention with a very small recording means, there can be provided a compact recording apparatus which can effect the recording on various kinds of sheets.

What is claimed is:

1. A sheet supplying apparatus comprising:

sheet stacking means for stacking a plurality of sheets;

sheet supply means for feeding out the sheets stacked on said sheet stacking means;

separation means for separating the sheets fed by said sheet supply means one by one; and guide means having a guide surface for guiding the sheet separated by said separation means toward a downstream side;

wherein said sheet stacking means is provided at its downstream end with a projection which protrudes toward downstream sides of said separation means and of a front side of guide surface of said guide means in a sheet supplying direction.

2. A sheet supplying apparatus according to claim 1, wherein said guide surface is an inclined surface inclined at a predetermined angle with respect to the sheet supplying direction, and is provided with a notch into which said projection is received.

3. A sheet supplying apparatus according to claim 1, wherein said guide surface is constituted by a plurality of rib members each having a tip end inclined at a predetermined angle with respect to the sheet supplying direction, so that said projection is received between said rib members.

4. A sheet supplying apparatus according to claim 1, wherein said separation means is attached to the front side of said guide surface of said guide means in the sheet supplying direction and said separation means separates the sheets by abutting the sheets against said separation means to cause elastic angular change thereby to ride the sheet over said separation means.

5. A sheet supplying apparatus according to claim 4, wherein said guide surface is inclined in a direction to guide the sheet so that, when the sheet fed out by said sheet supplying means abuts against said separation means to become upwardly-convex, a tip end portion of the sheet not opposed to said separation means abuts against said guide surface to ride the sheet over said separation means.

6. A sheet supplying apparatus according to claim 5, further comprising a regulating means for regulating deflection of the sheet when the sheet fed out by said sheet supply means abuts against said separation means to become upwardly-convex.

7. A sheet supplying apparatus according to claim 4, wherein said separation means comprises an elastically deformable thin plate-shaped member.

8. A sheet supplying apparatus according to one of claims 1 to 4, wherein said guide surface is inclined in a direction to guide the sheet so that, when the sheet fed out by said sheet supply means abuts against said separation means to become upwardly-convex, a tip end portion of the sheet not opposed to said separation means abuts against said guide surface to ride the sheet over said separation means, and wherein said separation means comprises an elastically deformable thin plate-shaped member.

9. A sheet supplying apparatus according to claim 1, wherein said sheet supporting means comprises a sheet stacking plate pivotally supported by the sheet supplying apparatus so that said stacking plate can be moved to urge the sheet against said sheet supplying means during a sheet supplying operation.

10. A sheet supplying apparatus according to claim 1, wherein said guide surface is inclined in a direction to guide the sheet so that, when the sheet fed out by said sheet supply means abuts against said separation means to become upwardly-convex, a tip end portion of the sheet not opposed to said separation means abuts against said guide surface to ride the sheet over said separation means, and wherein said sheet supporting means comprises a sheet stacking plate pivotally supported by the sheet supplying apparatus so that said stacking plate can be moved to urge the sheet against said sheet supply means during a sheet supplying operation.

11. A sheet supplying apparatus according to claim 9 or 10, wherein a plurality of said projections are provided on an end of said sheet stacking plate in a sheet supplying direction.

12. A sheet supplying apparatus according to claim 1, wherein said guide surface is inclined in a direction to guide the sheet so that, when the sheet fed out by said sheet supply means abuts against said separation means to become upwardly-convex, a tip end portion of the sheet not opposed to said separation means abuts against said guide surface to ride the sheet over said separation means, and wherein a plurality of said projections are provided on an end of said sheet supporting means in a sheet supplying direction.

13. A recording apparatus comprising:

sheet stacking means for stacking a plurality of sheets;

sheet supply means for feeding out the sheets stacked on said sheet stacking means;

separation means for separating the sheets fed by said sheet supply means one by one;

guide means having a guide surface for guiding the sheet separated by said separation means toward a downstream side; and a recording means for effecting the recording on the sheet separated by separation means;

wherein said sheet stacking means is provided at its downstream end with a projection which protrudes toward downstream sides of said separation means and of a front side of said guide surface of said guide means in a sheet supplying direction.

* * * * *

UNITED STATES PATENT AND TRADEMARK OFFICE

CERTIFICATE OF CORRECTION

PATENT NO. : 6,095,515

DATED : August 1, 2000

INVENTOR(S): TAKEHIKO KIYOHARA, ET AL.

It is certified that error appears in the above-identified patent and that said Letters Patent is hereby corrected as shown below:

COLUMN 2:
Line 41, "11d" should read --lid--.

COLUMN 3:
Line 41, "synchronous" should read --synchronism--.

COLUMN 4:
Line 24, "synchronous" should read --synchronism--; and
Line 59, "nontoothed" should read --non-toothed--.

COLUMN 6:
Line 11, "$U_2 \approx U_3$," should read --$U_2 \approx U_3$,--;
Line 47, "$A_1 \approx F_8, L_2{}^2K_1$" should read --$A_1 \approx F_8L_2{}^2K_1$--; and
Line 62, "$A_2 \approx F_7L_3{}^2K_2$" should read --$A_2 \approx F_7L_2{}^2K_2$--.

COLUMN 7:
Line 34, "$A_1° + A_2° \approx 90° - \Theta°$" should read --$A_1° + A_2° \approx 90° - \Theta°$--;
Line 43, "$K_{1-6}/K_{1-9} \approx 13$" should read --$K_{1-6}/K_{1-9} \approx 13$--; and
Line 44, "thin" should read --a thin--.

COLUMN 8:
Line 27, "becomes to satisfy" should read --satisfies--.

COLUMN 11:
Line 45, "shorter" should read --shorter than--; and
Line 64, "$S_1$." should read --$S_1$--.

UNITED STATES PATENT AND TRADEMARK OFFICE

CERTIFICATE OF CORRECTION

PATENT NO. : 6,095,515

DATED : August 1, 2000

INVENTOR(S): TAKEHIKO KIYOHARA, ET AL.

It is certified that error appears in the above-identified patent and that said Letters Patent is hereby corrected as shown below:

COLUMN 12:
Line 12, "11a" should read --11a--.

COLUMN 13:
Line 2, "of guide" should read --of said guide--.

COLUMN 14:
Line 38, "a" should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*